United States Patent [19]

Rozansky

[11] 3,967,535

[45] July 6, 1976

[54] UNIFLOW STEAM ENGINE

[76] Inventor: Murry I. Rozansky, 117 Joyce Kilmer Ave., New Brunswick, N.J. 08902

[22] Filed: Feb. 21, 1974

[21] Appl. No.: 444,540

[52] U.S. Cl. ..... 91/197; 91/166; 91/247; 91/330; 91/335; 91/502; 92/31; 92/71; 92/117 R; 92/144; 92/150; 137/637.5

[51] Int. Cl.[2] ..... F01B 13/04

[58] Field of Search ..... 91/196, 197, 247, 325, 91/330, 335, 61, 429, 502, 166; 92/31, 70, 71, 117 R, 117 A, 144, 150, 151; 417/492, 500; 137/637.3, 637.5

[56] References Cited

UNITED STATES PATENTS

| | | | |
|---|---|---|---|
| 1,046,827 | 12/1912 | McCollum | 92/144 X |
| 1,321,045 | 11/1919 | Hutchinson | 91/502 X |
| 1,556,300 | 10/1925 | Olsen | 92/150 X |
| 1,580,249 | 4/1926 | Hornor | 92/144 X |
| 1,647,561 | 11/1927 | Coward | 91/325 X |
| 1,759,946 | 5/1930 | Kasley | 92/150 X |
| 2,521,557 | 9/1950 | Wyckoff | 91/196 X |
| 2,948,265 | 8/1960 | Jensen et al. | 92/31 X |
| 3,477,345 | 11/1969 | Johnson | 92/31 X |
| 3,828,655 | 8/1974 | Williams | 92/31 |

*Primary Examiner*—Martin P. Schwadron
*Assistant Examiner*—Abraham Hershkovitz

[57] ABSTRACT

A uniflow steam engine of the multi-cylinder type wherein the cylinders are rotatably mounted within a jacket having a sinusoidal cam track therein. Extending through slots, the ends of which are the exhaust ports in the cylinders and into the cam track are cam followers which are mounted on the pistons for reciprocable movement therewith. At the head end of the cylinders there are apertures which rotate with registered cutouts in superimposed valve rings that control the flow of steam from manifolds at the head ends of each of the cylinders into the cylinders as the cylinders rotate. By adjusting the relative position between the valve rings, the length of time of steam introduced on each cycle may be adjusted and by concomitantly rotating both valve rings, the initial time for introduction of steam may be adjusted to alter lead or reverse torque.

14 Claims, 8 Drawing Figures

UNIFLOW STEAM ENGINE

BACKGROUND OF THE INVENTION

1. Field of the Invention

This invention relates to uniflow steam engines and particularly to uniflow steam engines wherein the cylinders are caused to rotate in response to reciprocation of the pistons. Most particularly this invention relates to uniflow steam engines having a novel valving means for controlling the introduction of steam into the cylinders.

2. The Prior Art

Uniflow steam engines are well known in the prior art. Steam engines wherein a reciprocating piston imparts rotary movement to the cylinder are also known.

DESCRIPTION OF THE PREFERRED EMBODIMENTS

Figure 1:
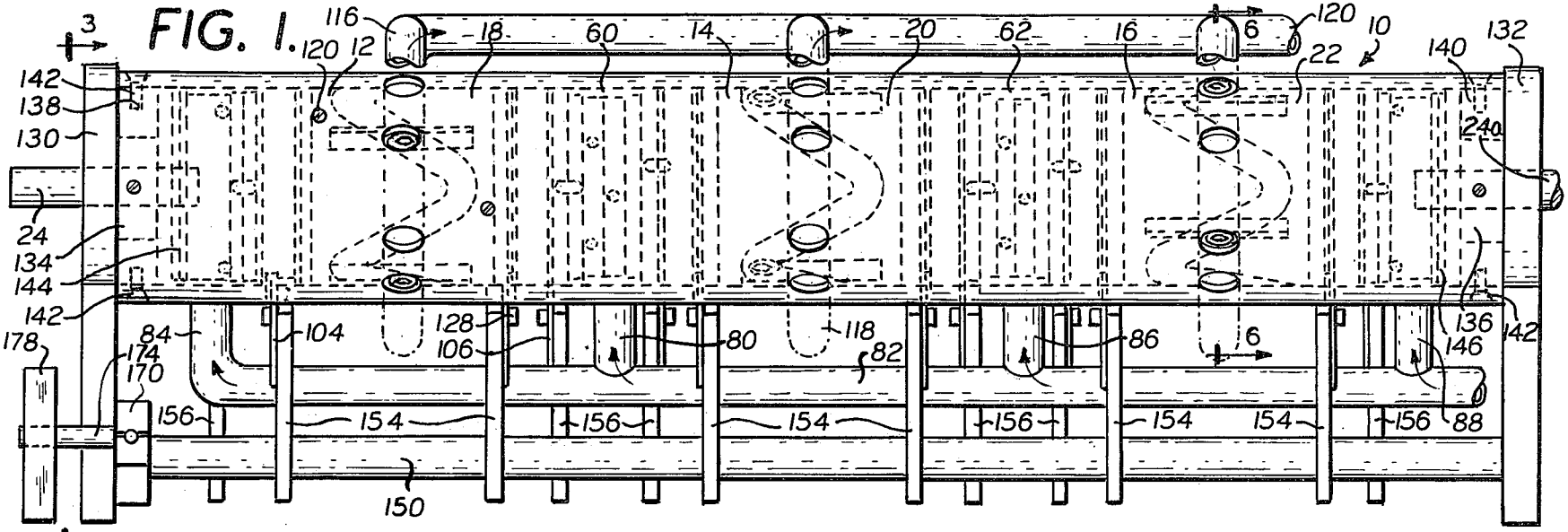
FIG. 1 is a side plan view of a uniflow steam engine embodying the present invention.
Figure 2:
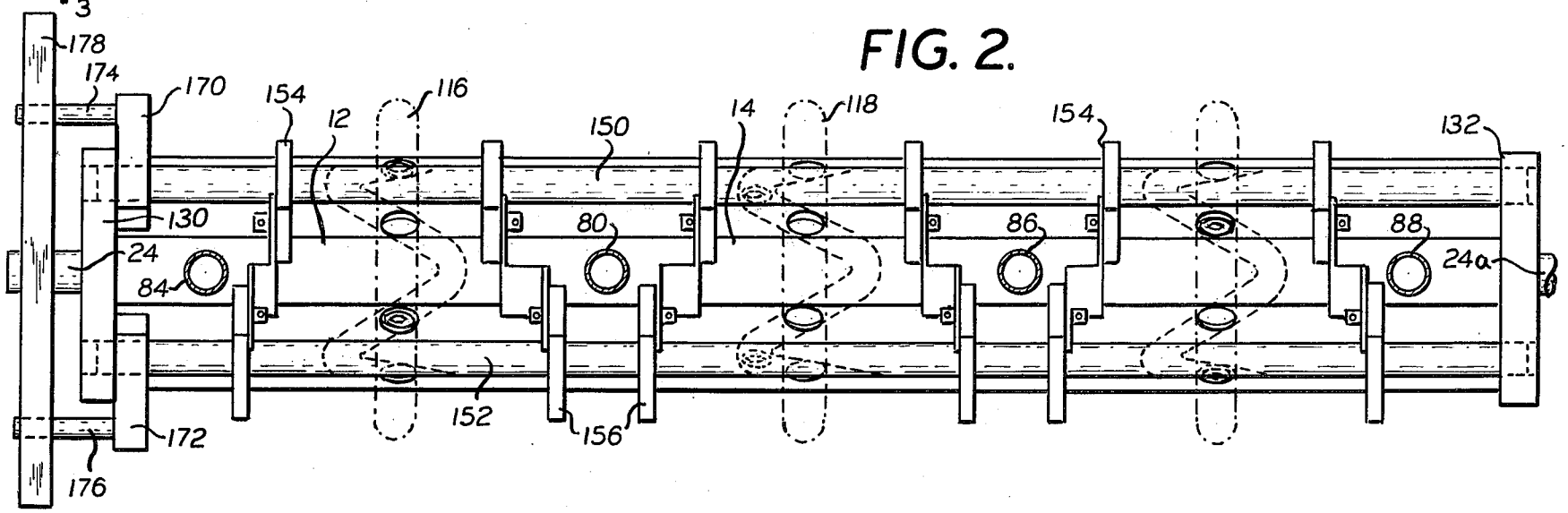
FIG. 2 is a bottom view thereof with certain parts deleted.

Referring now to the drawings in detail and especially to FIGS. 1 and 2 thereof, the engine of the present invention is generally designated by the reference numeral 10 and contains three cylinders 12, 14 and 16 looking from left to right as viewed in FIGS. 1 and 2. The number of cylinders is not critical and clearly there could be any desired number, although it is preferred that there be at least two. Disposed within the cylinders 12, 14 and 16 are double-acting pistons 18, 20 and 22, respectively. As will be more fully understood hereinafter, steam is alternately admitted into opposite ends of the cylinder to cause the double-acting pistons to reciprocate and, by means hereinafter to be described the reciprocation of the pistons will impart rotary movement to the cylinders which are ultimately connected to an output shaft 24.

Figure 7:
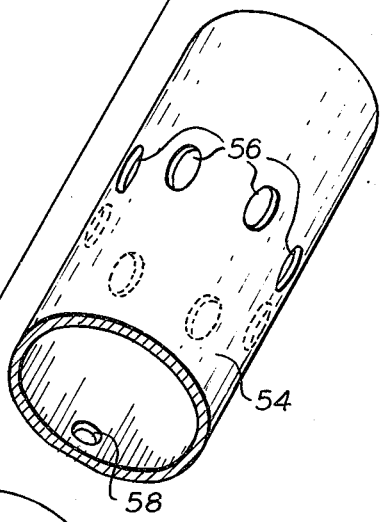
FIG. 7 is an exploded perspective view of one piston and cylinder of the engine of the present invention.

Each of the piston and cylinder arrangements 12–18, 14–20 and 16–22 is substantially identical. For illustrative purposes, one of the cylinders and pistons 12–18 are shown in FIG. 7. It will be understood that the others are constructed in a similar fashion. The cylinder 12 is an elongated tubular member having a plurality of longitudinally extending slots here shown as four in number and designated by the reference numerals 26, 28, 30, and 32. The piston 18 is slidably disposed within the cylinder. Fixed to the piston 18 and protruding radially outwardly therefrom through the slots 26 to 32, respectively, are four cam followers 34, 36, 38, and 40, respectively. Preferably, and as shown best in FIG. 7, each of the cam followers comprises a cylindrical roller bearing 42 and a tapered roller bearing 44, both fixed to the piston 18 as by a threaded stud 45.

The cylinder 12 is rotatably mounted within a cam member 46, which cam member as shown is made of two complementary cam pieces 48 and 50 that are spaced apart by a sinusoidal cam track 52 here shown as making four complete sinusoidal cycles about the circumference of the cam member 46. The four cam followers 34 to 40, being disposed at 90° to one another, are at corresponding phase points on the sinusoidal cam track 52 but in different cycles thereof. Naturally, if only three cam followers were employed they would be disposed at 120° to one another about the circumference of the piston, there would be only three elongated slots in the cylinder also disposed at 120° to one another, and the cam track on the cam member 46 would make only three cycles as it extends about the circumference thereof. This would effect the relative speed of rotation of the cylinder as will be understood more fully hereinafter. The cam followers extend outwardly from the cylinder sufficiently far to be disposed within the cam track 52 but they do not extend beyond the outer surface of the cam member 46. Thus the cam member 46 may be slidably disposed within a non-rotatable stationary exterior jacket 54 having a multiplicity of steam inlets and outlets and fixed relative thereto. The inlets and outlets help to form paths for the introduction of steam into the cylinder and for the passage of steam therefrom.

As will be more fully understood hereinafter, as the piston 18 moves back and forth in the cylinder 12 due to the expansion of steam in the clearance space between the cylinder head and the piston, the cam followers 34, 36, 38 and 40 move back and forth through the slots 26 to 32 inclusive in the cylinder and also move through the sinusoidal slot 52 in the non-rotatable cam member 46, whereby to cause the piston 18 and the cylinder secured thereto by the cam followers against relative rotation, to rotate about their longitudinal axes. To reduce friction due to the engagement of the cam followers with the cylinder slots 26 to 32 and with the sinusoidal cam slot 52, and as previously noted, each of the cam followers is constructed of two rollers, cylindrical roller 42 relatively close to the piston surface and ridable in a cylinder slot and tapered roller 44 that is disposable within the sinusoidal slot 52 of the cam member 46. These two rollers are held against translation relative to the piston by means of the securing member 45 which may be a shoulder screw or the like. The reason for the outer rollers 44 being tapered is that they move through arcuate paths at the apeces of the sinusoidal slot 52 and the tapering assures constant rotary movement through the entire periphery of the roller whereby to eliminate any sliding movement which would of course increase the friction of the engine.

Thus to assemble any one cylinder 12 of this multicylinder uniflow engine 10, the piston 18 is disposed within the cylinder 12 with the screw holes for receiving the screws 45 in register with the slots 26 to 32 in the cylinder 12. The piston and cylinder then have disposed about them the two cam member portions 48 and 50 which are located on the cylinder 12 in close fitting relation and are spaced apart to define the sinusoidal cam slot 52. During assembly the cam member portions 48 and 50 are rotated and translated relative to the piston and cylinder until each of the screw holes in the piston not only registers with the slots in the cylinder but also registers with the cam slot 52. The cam followers can then be assembled by disposing rollers 44 and 42 on a machine screw 45 and then inserting the machine screw through the registered slots in the cam member 46 and the cylinder 12 so as to be threadedly engaged with the underlying screwhole whereby to mount the cam followers. Thereafter, the outer jacket 54 is slidably disposed over the cam member 46 and is secured thereto by screws as will be described hereinafter, whereby to fix the location of the cam member portions 48 and 50 relative to the jacket 54 so that the steam outlet ports 56 all register with the cam slot 52 and the steam inlet port 58 is properly registered with the steam manifold as will be described hereinafter.

As previously stated the engine of the present invention is preferably a multicylinder engine, here shown as a three cylinder engine. To connect adjacent cylinders to one another bridging collars 60 and 62 are respectively provided between the cylinders 12 and 14 on the one hand and the cylinders 14 and 16 on the other. The collars are in tight fitting relation with the ends of the adjacent cylinders and are secured thereto as by any suitable securing means such as threaded screws 64, whereby to mechanically lock the cylinders to one another for simultaneous rotation. As shown best in FIG. 8, the cylinder heads 66 and 68 (and the other cylinder heads not shown in FIG. 8) are fixed to their respective cylinders by being abutted against the outer ends thereof while they snugly fit within the interior of the respective collars 60 and 62. Disposed between the cylinder heads 66 and 68 is a ring 70 which serves as a spacer ring between the two cylinder heads. The ring 70 is secured to the collar 60 by suitable securing elements such as screws 72. It will be seen that there is a space 74 between the cylinder heads 66 and 68 which space is in communication with the steam inlet manifold 76 by one or more apertures 78 (here shown as four in number) and collar 60 in the ring so that steam is always present in the space between the cylinder heads to serve as a pressure reserve and also to maintain the cylinder heads at about the input temperature of the steam. This has a salutary thermodynamic effect on the efficiency of the engine.

Figure 8:
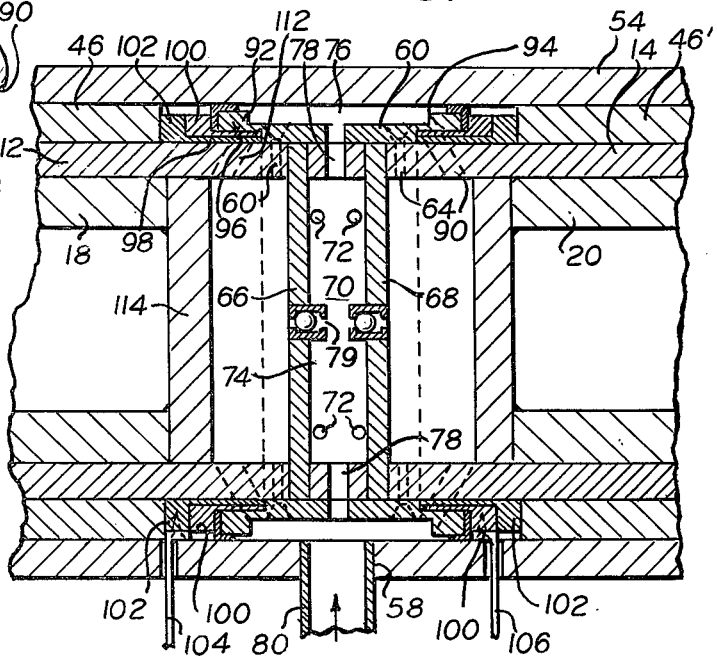
FIG. 8 is a fragmentary longitudinal sectional view showing the head ends of two opposed piston and cylinders.

As best seen in FIG. 8, in each cylinder head, preferably at the central axis thereof, there is a relief valve 79 for venting the clearance space to the space 74 in the event of an over-pressure condition in the cylinder. This acts as a safety valve to assure against any serious malfunction of the engine.

As just noted there is a space between the collar 60 and the outer jacket 54 which space has been specified to be steam inlet manifold 76. This manifold is annular in configuration as may best be seen in FIG. 8. Steam is introduced into the manifold 76 through the inlet opening 58 in the outer jacket 54 by means of a suitable steam branch pipe 80 that is supplied by a manifold 82 (see FIG. 1) which extends from a satisfactory boiler (not shown). It will be obvious to anyone skilled in the art of uniflow steam engines that a branch pipe must extend from the manifold 82 to each end of each cylinder in the engine and such branch pipes are designated in FIG. 1 by the reference numerals 84, 86 and 88.

As previously described the collars 60 and 62 and the jacket 54 define between them inlet steam manifolds for supplying steam to the head ends of the cylinders 12, 14 and 16. Means for controlling the supply of steam from the manifold 76 to the through holes 90 and 112 at both ends of each cylinder constitutes an important aspect of the present invention. In accordance with this feature of the present invention the collars 60 and 62 (as well as the end collars which will be described hereinafter) are provided with a pair of sets of through apertures 92 and 94, each set herein constituting four in number although the number will be dependent upon the number of turns of the cylinder per cycle of the piston. This, of course, is dependent upon the number of cycles that the sinusoidal cam track 52 goes through as it extends around the circumference of the cam member 46. Underlying the collars 60 and 62 at each end thereof are a pair of superposed bands 96 and 98 which are respectively connected to rings 100 and 102 that are rotatably mounted on the outside of cylinders 12 and 14. An exploded view of the band and ring arrangement may be seen in FIG. 9.

Collars 60 and 62 are fitted with seals at their outer edges, which contact the outer jacket 54 and prevent any substantial leakage of high pressure steam from the steam manifold 76. Collars 60 and 62 with their seals shield the valve bands 96 and 98 from the high pressure steam on their entire circumference except for the port areas 92 and 94. The outer surface of the cylinders 12 and 14 adjacent to ports 90 and 112 may be provided with channels which communicate with the high pressure steam space to counterbalance the pressure on the outer surface of the valve bands in the port areas 92 and 94. Control of steam flow to the balance channels may be by projections or recesses in the edge of the valve bands or by movement of the valve bands away from the cylinder blocking the steam passage to the balance passage when overbalanced by pressure in the port areas 90 and 112 to insure free relative movement. The running surfaces, on the cylinders 12 and 14 and the inner surface of the collars 60 and 62 and the mating surfaces of the valve bands 96 and 98 may be, in any combination, provided with channels supplied with high pressure steam or a series of tapered channels in the form of a self pumping gas bearing. The purpose is to support the valve bands 96 and 98 on a gas (steam) cushion to minimize friction and eliminate the need for liquid lubrication at the hottest part of the engine. This removes the temperature limitation imposed by the lubricant which in the past has prevented increasing the inlet temperature. The permissible increase in inlet temperature, a gas bearing makes possible increases in the thermal efficiency of the engine. This is a most important feature as the thermal efficiency of the engine determines the capacities of all the other elements of the system. Increased thermal efficiency not only reduces specific fuel consumption (lbs.fuel/hp/hr)-thereby increasing fuel economy, but allows the use of a smaller steam generator, cooling system and other accessories giving an overall reduction in size, weight and cost.

Figure 9:
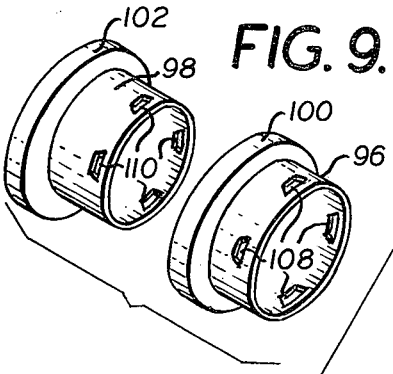
FIG. 9 is an exploded view of the valving rings of the present invention.
Figure 9:
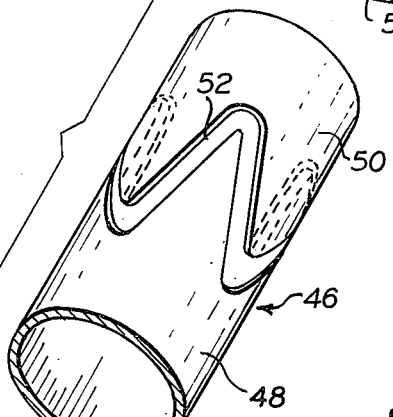
Figure 9:
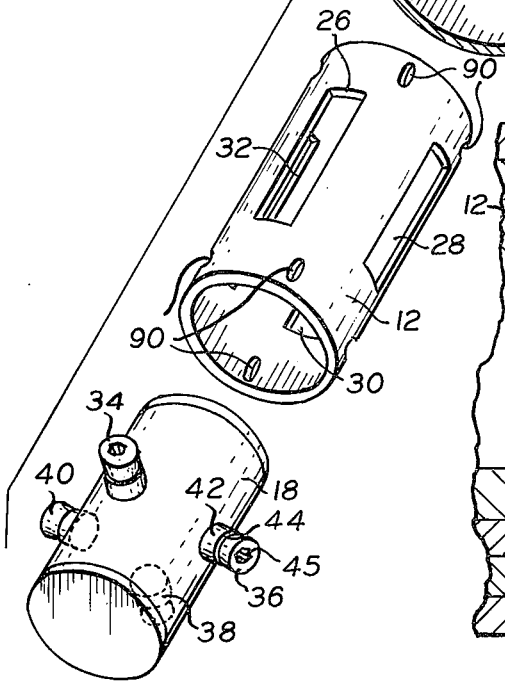

Referring to FIG. 9 it will be seen that the band 98 is slidably disposable within the band 96 with the rings 102 and 100 in close abutting relationship. The fit of these bands must be very close in order to prevent any substantial leakage of steam therebetween. Fixed to each of the rings 100 is a lever 106 and fixed to the rings 102 is a lever 104. By moving the levers 106 and 104, or either of them, the relative angular position of the bands 96 and 98 may be changed. Provided in the bands 96 are four trapezoidally shaped apertures 108 and provided in the bands 98 are four trapezoidally shaped apertures 110. When the band 98 is positioned within the band 96 as shown in FIG. 8, the apertures 108 and 110 are registrable with one another and with the apertures 92 and 94 in the collar 60. Thus a passage from the steam manifold 76 to the outside of the cylinders 12 and 14 may be provided by adjusting the relative positions of the bands vis-a-vis the apertures in the collar. As noted, the cylinders themselves are also provided with apertures 112 and 90 which are in permanent register with the apertures 92 and 94 in the collar 60, the collar being fixed relative to the cylinder. Thus, when the rings 100 and 102 are moved by the levers 106 and 104 to bring the apertures 108 and 110 into register with the apertures 112 and 92, passages for steam from the manifold to the clearance spaces at the end of the cylinders are provided whereby to permit the introduction of steam therein.

The locations of the apertures 108 and 110 in the valve bands at opposite ends of each cylinder are 180° out of phase, viewing one complete cycle of the sinusoidal cam track 52 on the cam member 46 as 360°. Thus, for example, in an engine of the type herein described wherein the cam track makes four complete cycles about the circumference of the cam member 46, the apertures 108 and 110 in the valve bands at one end of a cylinder are disposed at 45° (180°/4) from the corresponding apertures 108 and 110 in the valve bands at the other end of the cylinder.

With such an arrangement, and assuming the levers 104 and 106 have been adjusted to register the apertures 108 and 110, and starting with a piston 18 in its right hand position as shown in FIG. 8, steam will be introduced into the clearance space at the right hand end of the cylinder 12 whereby to force the piston 18 to the left. As the piston 18 commences moving leftward, which leftward movement is permitted by virtue of the cam followers 34–40 sliding through slots 26–32 in the cylinder, the cam followers will impart rotary movement to the cylinder due to the fact that the piston will be caused to rotate by the sinusoidal cam track and the rotation of the piston will impart rotation to the cylinder which is locked against rotation relative to the cylinder by the cam followers. The leftward movement of the piston 18 and the concomitant rotation of the cylinder will move the aligned apertures 92 and 112 which are actually physically part of the cylinder out of alignment with the registered apertures 108 and 110 in the bands 96 and 98 whereby to cut off supply of steam to the clearance space at the right hand end of the cylinder 12. The steam however will continue to expand and drive the piston to the left until it reaches the extreme left hand position at which point the piston and cylinder will have rotated 45° whereby to bring the apertures 90 and 94 at the left hand end of the cylinder into register with the aligned apertures 108 and 110 associated with the bands 96 and 98 at the left hand end of the cylinder to now permit the introduction of steam into the clearance space at the left hand end of the cylinder whereby to cause rightward movement of the piston. Rightward movement of the piston will continue to cause the piston to rotate by virtue of the reaction of the cam followers on the sinusoidal cam track 52. The rotation of the piston will impart rotation to the cylinder which, as will be shown hereinafter, is the output element of this engine.

The leftward movement of the piston 18 from its extreme right hand position will cause the head end of the piston designated by the reference numeral 114 to move past the right hand end of the slots 26 to 32 in the cylinder 12 whereby to vent the enlarged clearance space between the cylinder head 66 and the right hand end of the piston 114 through the slots 26–32 and into the cam track 52 and then out through the exhaust ports 56 in the jacket 54. When the piston moves from left to right, power from expanding steam positively drives the piston until the left hand end of the piston clears the left hand end of slots 26 and 32 whereupon the enlarged clearance space between cylinder head 68 and the left hand end of the piston is vented through slots 26–32 and cam track 52 to the exhaust ports 56 in jacket 54. While the use of the slots 26–32 in the cylinder as the exhaust ports for this engine is preferred, it should be recognized that if the engine is elongated, separate exhaust ports could be provided at both ends of the slots without departing from this invention.

As may best be seen in FIGS. 1 and 2, encircling each group of exhaust ports 56 associated with each cylinder is an annular exhaust manifold 116 surrounding the jacket 54 and having a plurality of outlet pipes 118 connected to the exhaust ports 56. All of the exhaust manifolds are connected to a single exhaust pipe 120 which will conduct the spent exhaust steam to a condensor for recirculation through a closed system or, in the alternative, to the atmosphere if a nonrecirculating system is employed.

The valving means including the registered apertures 90 and 94 or 112 and 92 that rotate with the cylinders and the registrable apertures 108 and 110 fixed to the bands 96 and 98 provides a means for regulating the amount of steam introduced into the clearance space at each cycle of operation whereby to control the power output of the engine. This is accomplished simply by rotating the band 96 relative to the band 98 in order to control the amount of overlap of the apertures 108 and 110 whereby to control the amount of time that the apertures 90 and 94 or 112 and 92 actually register with the passage defined by the overlapping apertures 108 and 110 to thereby regulate the amount of steam introduced. Clearly, if the apertures 108 and 110 are coincident with one another then a maximum amount of steam will be introduced into the clearance space during a given cycle. If the apertures 108 and 110 are completely out of overlapping relationship, then no steam will be introduced into the clearance space and the steam flow will be stopped. Intermediate amounts of overlap will give intermediate amounts of power output.

Further, by moving the rings 100 and 102 simultaneously the timing of the introduction of steam into the clearance space can be altered whereby to provide for a reversal of engine operation. Thus it is well known to those skilled in the art that, depending on whether steam is introduced just prior to the end of the stroke of the piston or just after the end of the stroke of the piston, the engine will operate in one direction or the other. Since both bands 96 and 98 are rotatable, they may be shifted concomitantly to provide for register with the cylinder openings 90 and 94 or 92 and 112 either just before the end of the stroke or just after the end of the stroke, whereby to yield easy means for reversing direction through the mechanism of the valves themselves.

As previously mentioned, it is desirable that each of the piston-cylinders in the alignment be out of phase with each other whereby to insure a steady delivery of torque to the output shaft 24 of the engine throughout its operation. Such angular displacement also minimizes vibration of the engine. It is for this reason that a multicylinder arrangement is to be preferred and why at least three cylinders have proved to be effective in the experimental device constructed to date. Thus, in a multicylinder arrangement as illustrated, the outer jacket 54 may be a single unitary cylindrical piece with three groups of eight exhaust ports 56 distributed about the center line of each of the cylinders underlying the outer jacket. Disposed underneath the integral outer jacket 54 and fixed thereto by screws 120 are the cam member parts 48 and 50, there being a pair of such parts for each cylinder. Thus, the cam members 46 are fixed relative to the jacket and cannot rotate with respect thereto. Underlying each of the cam members 46 is a cylinder 12, 14 and 16 which cylinders are located relative to one another at 120 cycle degrees, or 30° in the physical arrangement as shown, it being recognized that 120 cycle degrees is equal to 30° in an engine wherein the cam track makes four complete cycles per revolution of the cylinder. As already described, the cylinders are fixed to one another by means of the collars 60 and the screws 64 so that they all rotate together and thereby continuously deliver power to the shaft 24. The outer ends of the endmost cylinders 12 and 16 have constructions similar to the construction shown in FIG. 8 although those structures are not for the purpose of connecting cylinders to one another but instead for connecting the outermost ends of the cylinders to the output shaft 24. Thus, as may best be seen in FIG. 1, the two ends of the output shaft 24 designated 24 and 24A, respectively, are mounted on stationary end pieces 130 and 132 by bearings 134 and 136, respectively, which are set into end blocks 138 and 140, respectively. The end blocks 138 and 140 are secured as by screws 142 which extend through the outer jacket 54 and into end blocks 138 and 140. The shaft extends through the bearings and into an end disc 144 and 146 defining the outer end of the steam spaces 74 at the outermost ends of the engine. The manner of securing the shaft to the end discs is a matter of engineering choice and may be accomplished either by having end discs integral with the end of the shaft or by welding or by screws or the like. Suffice it to say however that the innermost surfaces of the end discs serve as one wall of the steam space for the outermost ends of the two outermost cylinders to yield a structure otherwise identical with the structure of FIG. 8. If desired, the end discs 144 and 146 may be spaced from the bearing blocks 134 and 136 respectively, whereby to prevent overheating of the bearings and/or insulated from the steam space 74 by additional walls, materials and/or space.

Thus it will be seen that with steam being supplied to the inlet pipe 82 which steam will be distributed to the branch pipes 80, 84, 86 and 88, the pistons will move back and forth under the automatic valving arrangement provided by the valving bands 96 and 98 to sequentially deliver power to move the pistons and cause them to rotate with the cylinders in which they are reciprocating. The rotating cylinders are all connected together and therefore transmit the power of rotation to the shaft 24 by means of the end structure hereinbefore described.

Figure 3:
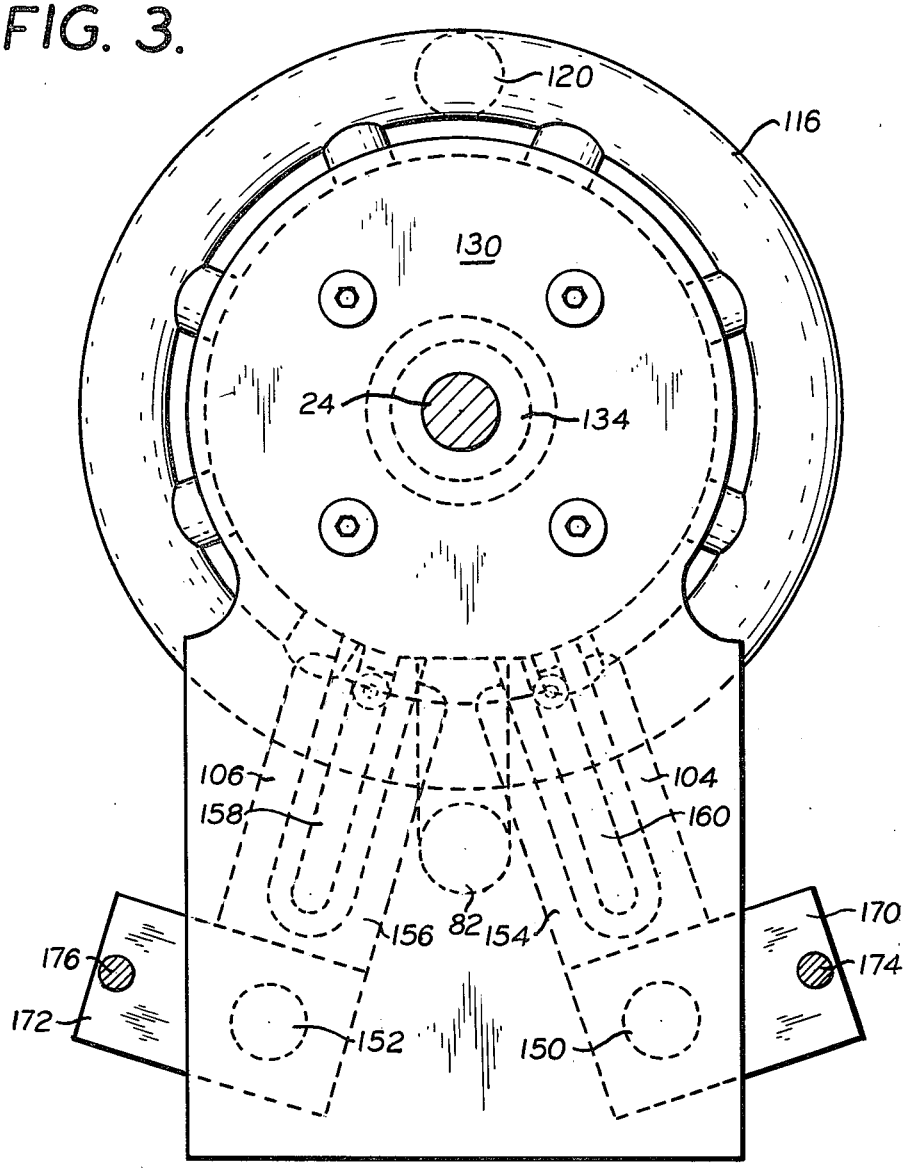
FIG. 3 is a sectional view taken along the line 3—3 of FIG. 1.

Since the cylinders must work on similar timing in order to provide the most efficient delivery of continuous power from the various pistons to the rotating cylinder structure and to the output shaft, means are provided for simultaneously controlling the relative positions of the valving bands 96 and 98, as well as their absolute position relative to their respective pistons, in order to maintain the proper timing. As may be seen in FIGS. 3, 4 and 5, this is accomplished by means of a pair of shafts 150 and 152 that are rotatably mounted in the end pieces 130 and 132 and extend the full length of the engine. Secured to each of the shafts 150 and 152 are a plurality of cranks 154 and 156 which are connected to the levers 104 and 106, respectively, that are fixed in turn to the rings 102 and 100, respectively, for rotating said rings. The pivotal connections between the cranks and the levers are by means of shoulder screws 128 threadedly mounted on the cranks and extending through slots 160 and 158 in the levers 104 and 106, respectively. When the shaft 150 or 152 is rotated, the cranks 104 or 106 rotate therewith and cause the shoulder screws to move angularly and translate in the slots 160 or 158 whereby to impart rotary movement to their associated valve band 98 and 96. Accordingly, the absolute position of each of the valve bands 98 at each end of each cylinder can be controlled by rotation of the shaft 150, while maintaining their relative angular position between one another fixed, and the angular positon of the bands 96 can be simultaneously rotated by rotating the shaft 152, the bands 96 maintaining a fixed relative position therebetween. Clearly, rotation of one set of bands without the concomitant rotation of the other will alter the size of the openings through which the steam must pass to drive the pistons. Thus, by manipulating either of the shafts 150 or 152 while maintaining the other stationary, the amount of power to be delivered can be controlled. To reverse the engine it is clear that both shafts 150 and 152 must be moved whereby to shift the location of register of the apertures 108 and 110 with the apertures 90 and 94 and 112 on the cylinders to cause the introduction of steam either before or after the piston reaches the extreme end position of its stroke.

Figure 4:
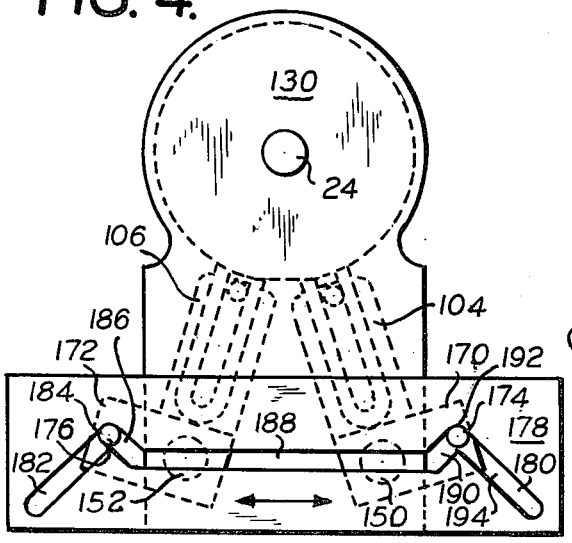
FIG. 4 is an end view showing the throttle control means in its "off" condition.
Figure 5:
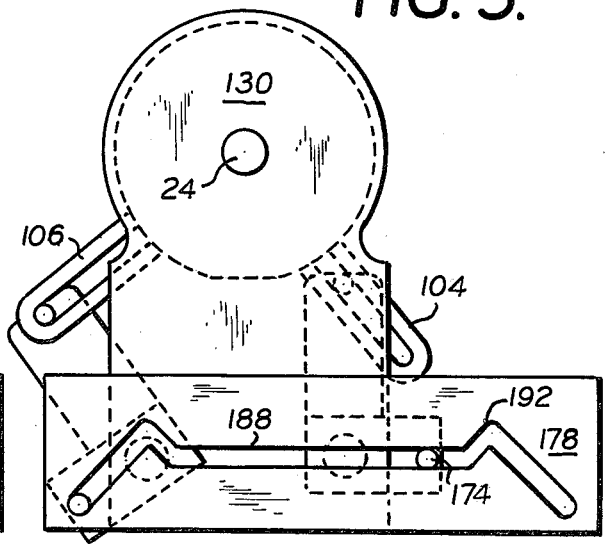
FIG. 5 is a view similar to FIG. 4 showing the throttle control means in its full throttle forward condition.
Figure 6:
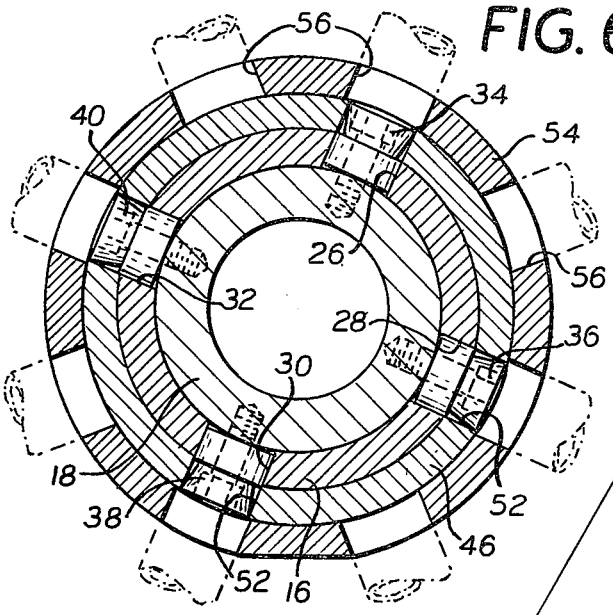
FIG. 6 is a sectional view taken along the line 6—6 of FIG. 1.

Means may be provided for single lever operation of the valving mechanism for controlling both the delivery of desired amount of steam at each half cycle of each stroke of each piston and for controlling when that steam is delivered to the particular end of the cylinder, and such means is illustrated schematically in FIGS. 4 and 5. This may be accomplished by affixing to each of the shafts 150 and 152 a crank 170 and 172, each of which is provided with a roller type cam follower 174 and 176. A reciprocably movable member 178 is provided with a cam track 180 for receiving the cam followers 174 and 176 therein. The cam track is provided with an angularly upwardly directed portion 182 that reaches an apex 184 and then extends downwardly and to the right, as seen at the reference numeral 186. The cam track then has an intermediate flat portion 188, a short upwardly and rightwardly directed portion 190 terminating at an apex 192. Thence continuing to move rightward there is a downwardly angularly directed cam track portion 194.

As shown in FIG. 4, the cam followers 176 and 174 are located at the apexes 184 and 192 of the cam track 180 and in this position the round bands 96 and 98 are rotated so that there is no registration between the apertures 108 and 110, whereby to cut off the supply of steam to the cylinders and thereby shut off the engine. Assuming the control member 178 is moved to the right from the position shown in FIG. 4 to the position shown in FIG. 5, it will force the cam follower 176 to move downwardly along the cam track portion 182 to the extreme lefthand end of the cam track 180 which forced movement will rotate the crank 172 counterclockwise whereby to rotate the levers 106 clockwise. Simultaneously, the cam follower 174 will be moved from the apex 192 to the flat portion 188 of the cam track 180 to thereby shift the crank slightly clockwise so as to move the band 102 counterclockwise a small amount just off the neutral position. In this position the two bands are now in full register with each other to provide maximum steam input. To reverse the direction of the engines, all that need be done is to shift the control member 178 to the left whereby to reverse the positions of the two cam followers 174 and 176 which will yield full reverse throttle. Positions intermediate the neutral position and either of the full throttle positions will yield partial throttle either in forward or reverse direction. This mechanism gives the desirable feature of shutting the supply of steam before reopening the valves in the opposite direction.

It is desired that the engine be operated so that the exhaust, while low pressure steam, is essentially pure steam with no water content, as water content will be deleterious to the efficiency of the engine. The particular amount of expansion, the input pressure and temperature and the output pressure and temperature are matters of engineering design well within the skill of the art.

It will also be recognized by the skilled art worker that packing and seals will be required at various locations in the engine. However, such packing and sealing has not been described herein as it is well within the skill of the art to provide such once the basic structure has been described as hereinbefore.

It will also be recognized that this device can be used not only as an engine but as a compressor. Clearly in such an instance the input manifolds etc. will serve as exhausts and the exhaust manifolds, etc. will serve as inputs. This compressor may be employed for steam or any other compressible fluid, such as, for example, air or freon.

While I have herein shown and described the preferred form of this invention and have suggested modifications thereto, other changes and modifications may be made therein within the scope of the appended claims without departing from the spirit and scope of this invention.

I claim:

1. A uniflow engine-compressor comprising:

a. a hollow cylinder having a longitudinally extending slot therein;

b. a piston reciprocably movably disposed within said cylinder;

c. a cylindrical cam member in surrounding relation with said cylinder and having a circumferentially extending sinusoidal cam track therein, said cylinder being rotatable within said cam member;

d. a cam follower mounted on said piston and extending radially outward therefrom through said longitudinal slot in said cylinder and into said cam track, whereby reciprocable movement of said piston within said cylinder will cause said piston and cylinder to rotate relative to said cam member;

e. a cylinder head at each end of said cylinder, said longitudinal slot in said cylinder being proportioned to prevent said piston from engaging either of said cylinder heads, whereby to define a clearance space at each end of said cylinder;

f. said cylinder having an aperture therethrough at each end thereof leading into said clearance spaces; and g. means for periodically passing compressible fluid through said apertures in said cylinder between said clearance spaces and outside of said cylinder comprising;

i. a pair of superposed bands at each end of said cylinder in overlying relationship with said cylinder and being relatively movable with respect to said cylinder apertures and with respect to each other;

ii. said bands each having an aperture therein registrable with said cylinder aperture at the corresponding end of said cylinder; and iii. means for moving said bands whereby to adjust the amount of register of said band apertures and said cylinder aperture and the point of such register, whereby to adjust the amount of compressible fluid passing through said cylinder apertures and the timing of such passage.

2. The engine compressor of claim 1, wherein the device is an engine, steam is the compressible fluid, and said steam is periodically introduced into said clearance spaces through said registered apertures on an alternating basis, whereby to drive said piston back and forth and impart rotation to said piston and cylinder, and means for exhausting said clearance spaces controlled by the movement of said piston.

3. The engine of claim 2, wherein said means for exhausting includes said longitudinal slot and said cam track.

4. The engine of claim 2, wherein there are two or more said cylinders and pistons and associated structure, said cylinders being in axial alignment, and means for connecting said aligned cylinders to one another for concomitant rotation.

5. The engine of claim 4, wherein said means for exhausting includes said longitudinal slot and said cam track.

6. The engine of claim 5, wherein said means for connecting said cylinders includes a cylindrical collar fixed to both cylinders in sealed relation therewith and having end portions spaced from an outer surface of said cylinders, said end portions having apertures in register with said apertures in the adjacent ends of said cylinders, said bands being disposed in the spaces between said end portions of said collar and said outer surfaces of said cylinders.

7. The engine of claim 6, wherein said bands are cylindrical and in encircling substantially steam-tight relation with said cylinder.

8. The engine of claim 7, further comprising an outer cylindrical jacket fixed to said cam members and defining an inlet manifold together with said collar, the means for exhausting including an aperture through said jacket.

9. The engine of claim 8, wherein the adjacent cylinder heads of the confronting ends of said two cylinders are spaced apart, and means are included for introducing steam into the space between said cylinder heads.

10. The engine of claim 9, further comprising means for passing steam to the sides of the non-confronting cylinder heads outside of said clearance spaces.

11. The engine of claim 4, wherein there are *n* apertures through each cylinder at each end, said apertures being equispaced about the circumference of said cylinder, said sinusoidal cam track defines *n* cycles about the circumference of said cam member, and wherein said bands are cylindrical and in encircling substantially steam-tight relation with said cylinder, and each have *n* apertures therein equally spaced thereabout, and *n* is an integer.

12. The engine of claim 11, further comprising an outer cylindrical jacket fixed to said cam members and defining an inlet manifold together with said collar, the means for exhausting including an aperture through said jacket.

13. The engine of claim 8, wherein said means for moving said bands comprises a lever for each band, a plurality of cranks, one for each lever, pivotally connected to each of said levers at one end, and a pair of rotatable shafts, the other end of one lever from each pair of bands being fixed to one of said rotatable shafts and the other end of the other of said levers from each pair of bands being fixed to the other of said rotatable shafts, whereby to operate said bands concomitantly.

14. The engine of claim 13, further comprising means for jointly rotating said pair of shafts.

* * * * *